US006126056A

United States Patent [19]

Ueno et al.

[11] Patent Number: 6,126,056

[45] Date of Patent: Oct. 3, 2000

[54] APPARATUS FOR ATTACHING TAG PINS

[75] Inventors: Hideyuki Ueno, Kanagawa; Akira Furutsu, Tokyo, both of Japan

[73] Assignee: Kotec's Co., Ltd., Tokyo, Japan

[21] Appl. No.: 09/437,415

[22] Filed: Nov. 10, 1999

[51] Int. Cl.[7] ..... B25C 1/00

[52] U.S. Cl. ..... 227/67; 227/140

[58] Field of Search ..... 227/67, 71, 119, 227/140, 148, 151

[56] References Cited

U.S. PATENT DOCUMENTS

| | | | |
|---|---|---|---|
| 4,492,330 | 1/1985 | Furutsu | 227/67 |
| 4,971,238 | 11/1990 | Furutsu | 227/67 |
| 5,024,365 | 6/1991 | Bourque | 227/67 |
| 5,033,664 | 7/1991 | Bone et al. | 227/67 |
| 5,501,002 | 3/1996 | Fukami | 227/67 |
| 5,878,935 | 3/1999 | Furutsu | 227/67 |

*Primary Examiner*—Scott A. Smith
*Attorney, Agent, or Firm*—Greer, Burns & Crain, Ltd.

[57] ABSTRACT

Apparatus for attaching tag pins prevents oscillation of a tag pin group several times as long as an ordinary tag pin group. The apparatus is formed by coupling heads and lateral bars through filaments into a product while separating the tag pins one by one from the tag pin group. The tag pin group is provided in a comb form in a long coupling bar through a coupling portion. A first tag pin group support guide of hook shape is rotatably supported on the top of the main body of the apparatus for attaching pins, and a second tag pin group support guide for preventing lateral swing of the tag pin group is disposed behind the first tag pin group support guide.

4 Claims, 8 Drawing Sheets

APPARATUS FOR ATTACHING TAG PINS

BACKGROUND OF THE INVENTION

1. Field of the Invention

The present invention relates to an apparatus for attaching tag pins not accompanied by worsening of working efficiency due to length of tag pin group if using a very long tag pin group as much as several times of length of ordinary tag pin group.

2. Description of the Related Art

Hitherto, in order to prevent oscillation of free end of the tag pin group inserted in a guide groove of the apparatus for attaching tag pins, the intermediate portion of the tag pin group is held by the guide fitted to the apparatus for attaching tag pins.

However, due to the progress in the die manufacturing technology and reduction of cost, tag pin groups of which length is more than several times of length of ordinary tag pin group are coming into use. When the tag pin group is so long, it is hard to prevent oscillation of tag pin groups during work only by the conventional guide, and the swinging thereof increases, causing the operation to use them to be complicated, and the tag pin group to be likely to be detached from the guide.

SUMMARY OF THE INVENTION

The invention is devised in the light of the problems mentioned above, and hence an object thereof is to provide an apparatus for attaching tag pins capable of preventing oscillation of a very long tag pin group as much as several times of length of ordinary tag pin group.

To solve the problems, the apparatus for attaching tag pins of the invention is an apparatus for attaching tag pins for driving tag pins formed by coupling heads and lateral bars through filaments into a product while separating the tag pins one by one from the tag pin group provided in a comb form in a long coupling bar through a coupling portion, in which a first tag pin group support guide of hook shape is rotatably supported on the top of the main body of the apparatus for attaching tag pins, and a second tag pin group support guide for preventing lateral swing of the tag pin group is disposed behind the first tag pin group support guide.

By thus supporting the first tag pin group support guide of hook shape rotatably on the top of the main body of the apparatus for attaching tag pins, and disposing the second tag pin group support guide for preventing lateral swing of the tag pin group behind the first tag pin group support guide, oscillation of the tag pin group between the main body of the apparatus for attaching tag pins and the first tag pin group support guide can be prevented by the first tag pin group support guide, and moreover lateral swing of the tag pin group can be prevented by the second tag pin group support guide.

In the invention, the second tag pin group support guide is composed of a pair of right and left protrusions for supporting the lateral bar or the tag pins from both sides.

Thus, by forming the second tag pin group support guide by the pair of right and left protrusions for supporting the lateral bar or the tag pins from both sides, lateral swing of the tag pin group after the first tag pin group support guide can be prevented.

Moreover, as in the invention, if the pair of right and let protrusions are disposed by deviating the phase in the longitudinal direction of the main body, lateral swing of the tag pin group after the second tag pin group support guide can be prevented.

Or, as in the invention, if the second tag pin group support side is composed only of protrusions disposed at the inlet and outlet sides of the tag pin group of the first tag pin group support guide, lateral swing of the tag pin group after the second tag pin group support guide can be prevented.

DETAILED DESCRIPTION OF THE INVENTION

Figure 1:
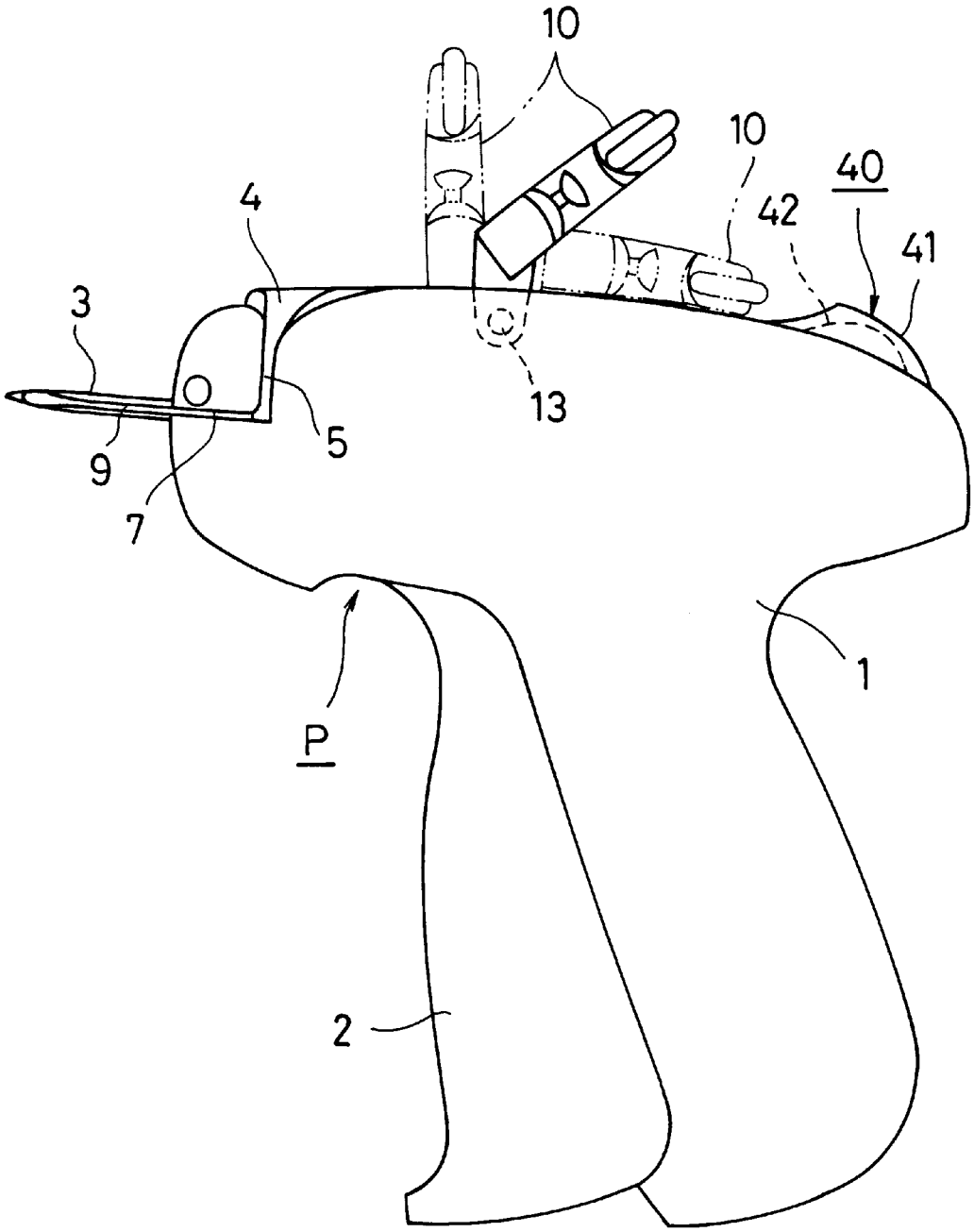
FIG. 1 is a side view of an apparatus for attaching tag pins according to the invention.

Referring now to the drawings, embodiments of the invention are described in detail below.

Figure 5:
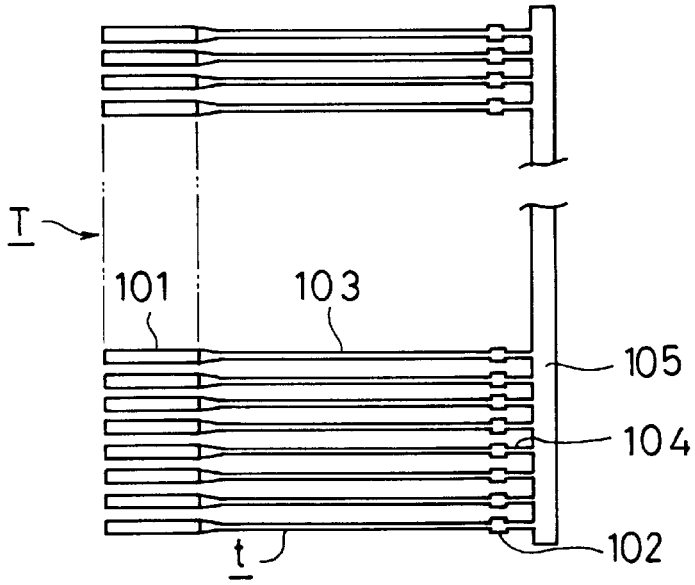
FIG. 5 is a side view of a tag pin group.
Figure 6:
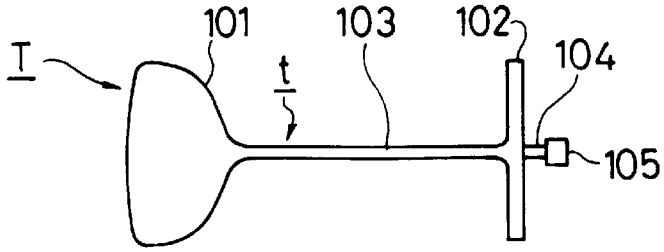
FIG. 6 is a plan view of the tag pin group.

Explaining the tag pin group before describing the apparatus for attaching tag pins of the invention, as shown in FIG. 5 and FIG. 6, a tag pin group T is integrally formed of synthetic resin, and multiple tag pins t are attached like a comb to a coupling bar 105 through a linear coupling portion 104. The tag pin t is formed of a flat head 101, a linear lateral bar 102, and a fine filament 103 for coupling the head 101 and lateral bar 102. The tag pin group T is about three times as long as in the ordinary case, and comprises about 150 to 250 tag pins t.

Referring now to the apparatus for attaching tag pins of the invention, as shown in FIG. 1, the apparatus for attaching tag pins P is formed nearly like a pistol, and by pulling a trigger 2 supported on its main body 1, the lateral bar (not shown) of the tag pin is driven into the product, not shown, through a hollow wire 3 attached to the leading end of the main body 1.

When the trigger is then released, the tag pin group T inserted into the guide groove 4 of the main body 1 is attracted by one pitch into the guide groove 4, and the lateral bar (not shown) of the tag pin positioned at the leading end of the tag pin group T waits immediately behind the rear end opening of the hollow needle 3.

Figure 2:
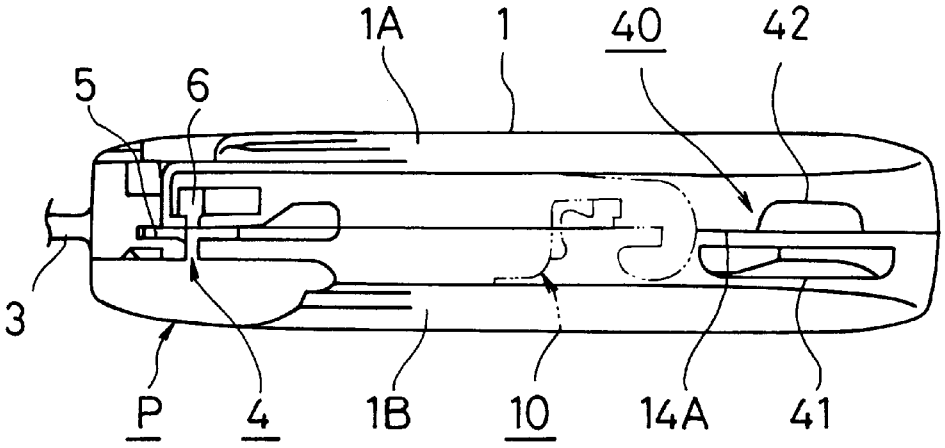
FIG. 2 is a plan view of the apparatus for attaching tag pins in FIG. 1.

As shown in FIG. 2, the guide groove 4 is composed of a T-groove 5 having bottom for inserting the lateral bar 102 of the tag pin 5 and part of the filament 103, and a penetration hole 6 for inserting the coupling portion 104 of the tag pin group T and the coupling bar 105, and the lower end of the T-groove 5 having bottom communicates with a slit 9 of the side of the hollow needle through a nearly horizontal communicating groove 7 as shown in FIG. 1.

Figure 3:
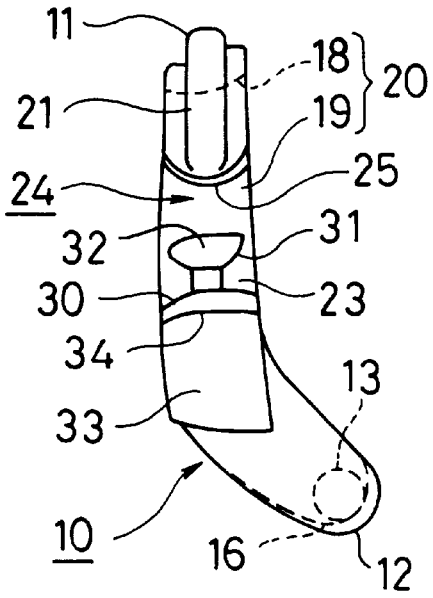
FIG. 3 is a side view of a first guide.

As shown in FIG. 1, nearly in the central position of the top of the main body 1, a first tap pin group support guide 10 (hereinafter called first guide 10) is rotatably supported by a pivot 13. The first guide 10 is formed of, as shown in FIG. 3, mainly a guide main body 11 and a base portion 12 fitted to the guide main body 11 at a specified angle.

Figure 4:
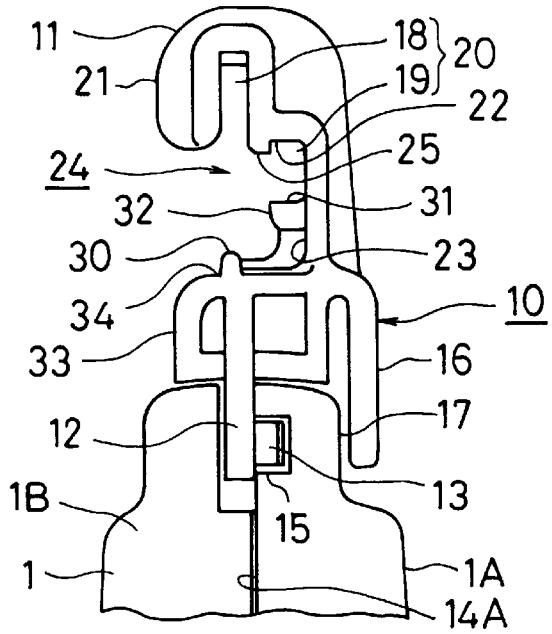
FIG. 4 is a rear view of the first guide.

The guide main body 11 is formed like a hook as shown FIG. 4, and has a tag pin group support groove 20 in a shape similar to the guide groove 4. The tag pin group support groove 20 is formed of a lateral bar support groove 18 for supporting one side portion of the tag pin group lateral bar 102, and a coupling bar support groove 19 for supporting the coupling bar 105 of the tag pin group. The lateral bar support groove 18 is provided in a hook portion 21 at the leading end of the guide main body, and the coupling bar support groove 19 is provided inside of the side 23 of the guide main body 11 so as to be opposite to an access 24 for putting the tag pin group T in and out of the main body left side 1B.

The coupling bar support groove 19 is large enough to insert the coupling bar 105 of the tag pin group, but to prevent dropout of the coupling bar 105 of the tag pin group, the edge 25 at the right side of the lateral bar support groove 18 is slightly projecting from the top 22 of the coupling bar support groove 19 toward the direction of a rib 31 which is one of the parts for composing the coupling bar support groove 19. The free end side 32 of the rib 31 is inclined, and approaches the side 23 of the guide main body 11 as going downward.

The guide main body 11 has a wedge-shaped stopper 30 so as to be opposite to the lateral bar support groove 18, and a step 34 is formed between the stopper 30 and the base 33 of the guide main body.

The pivot 13 provided inside of the base 12 is fitted into a hole 15 having bottom provided in the junction surface 14A of the main body right side 1A. Reference numeral 16 is an auxiliary base provided parallel to the base 12, and is formed along the outer side 17 of the main body right side 1A.

On the other hand, as shown in FIG. 1, behind the first guide 10, a second tag pin group support guide 40 (hereinafter called second guide 40) is disposed on the top of the main body 1. The second guide 40 is composed of a pair of right and left protrusions 41, 42 as shown in FIG. 2, and the left protrusion 41 is one side larger than the right protrusion 42 as shown in FIG. 1. The right protrusion 42 is disposed flush with the junction 14A of the main body right side 1A, while the left protrusion 41 is provided on the top of the main body left side 1B, and there is a gap enough for passing the lateral bar 102 of the tag pin between the two.

The operation for mounting the tag pin group T on the apparatus for attaching tag pins P is described below.

Figure 7:
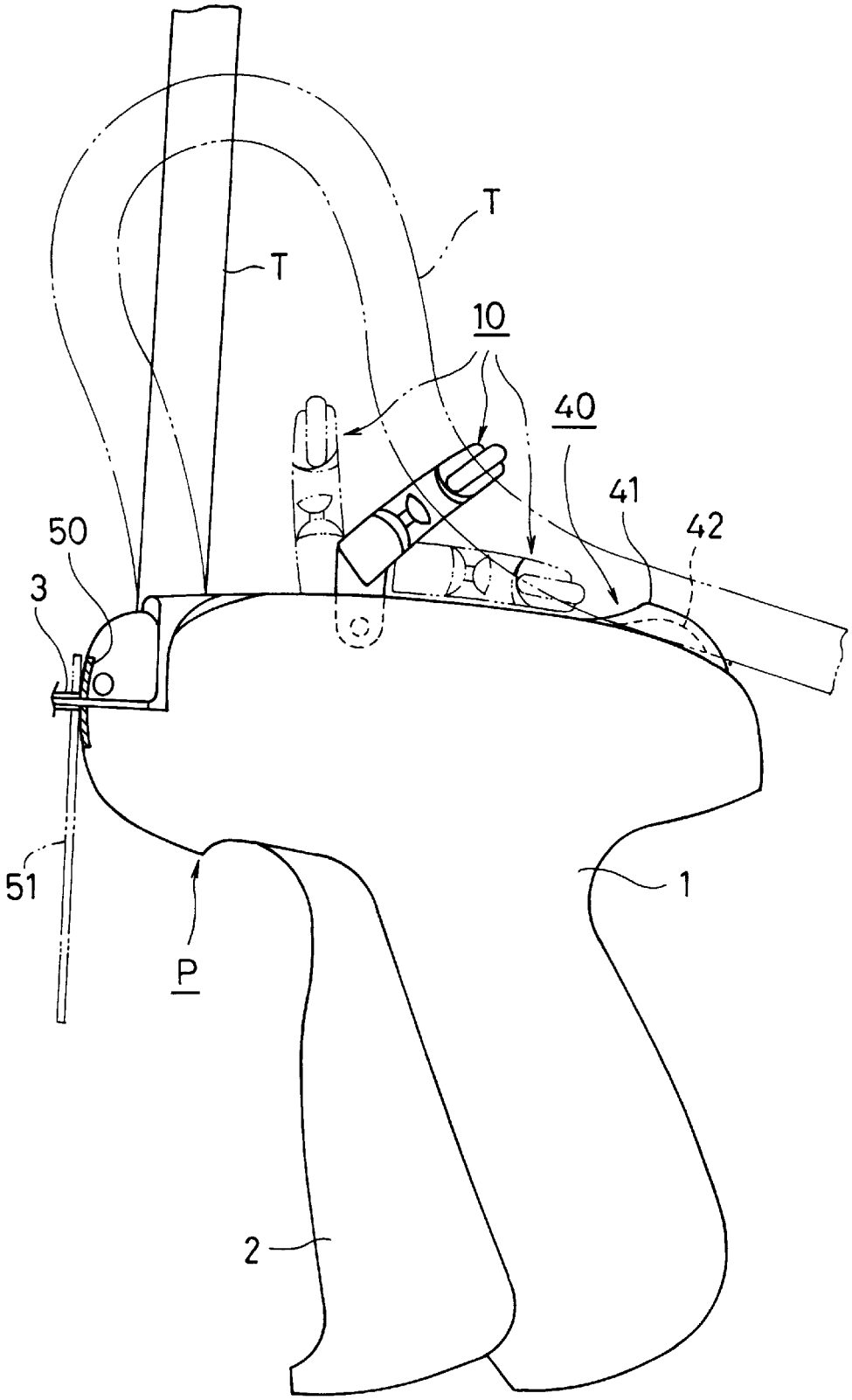
FIG. 7 is an operation explanatory diagram of the apparatus for attaching tag pins in the invention.

As shown in FIG. 7, after inserting the leading end of the tag pin group T into the guide groove 4 of the apparatus for attaching tag pins P (see the tag pin group T indicated by solid line), while curving the tag pin group T in a U-form, the intermediate portion is supported by the first guide 10.

Figure 8:
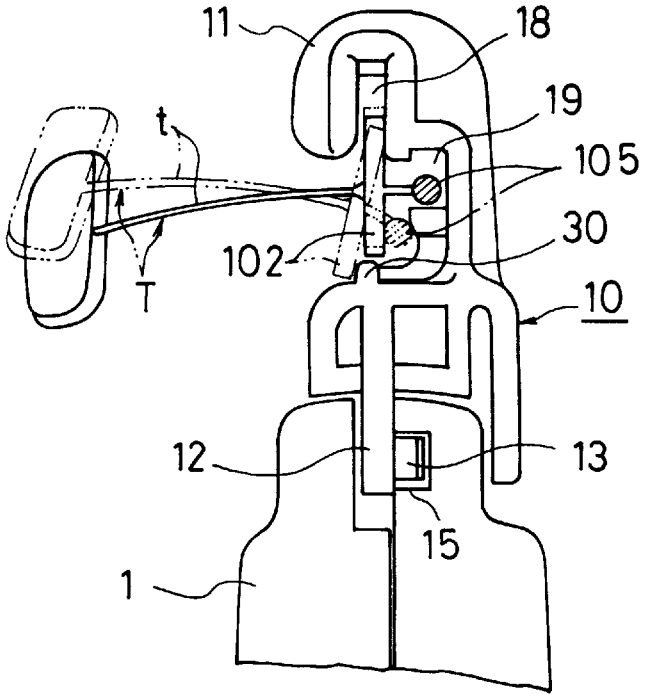
FIG. 8 is an explanatory diagram for mounting the tag pin group on the first guide.

At this time, as shown in FIG. 8, while fitting the lower end of the lateral bar 102 to the side of the stopper 30, when the upper end of the lateral bar 102 is guided into the lateral bar support groove 18, the sound is heard when the lower end of the lateral bar 102 is separated from the side of the stopper 30, and the lateral bar 102 of the tag pin is inserted into the lateral bar support groove 18 as indicated by solid line, and at the same time the coupling bar 105 of the tag pin group is inserted into the coupling bar support groove 19, so that it is not separated easily from these grooves 18, 19.

Figure 9:
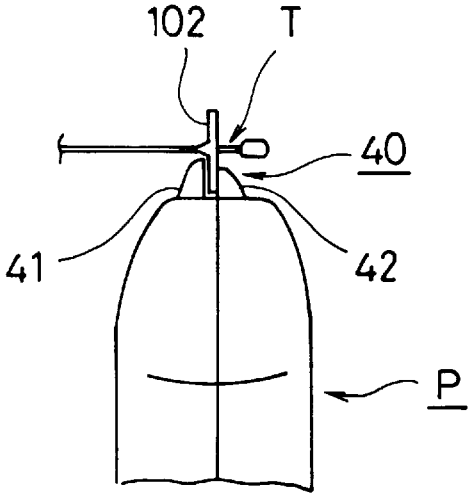
FIG. 9 is an explanatory diagram for mounting the tag pin group on a second guide.

Afterwards, as shown in FIG. 9, the lower end side of the lateral bar 102 is inserted into the gap between the pair of right and left protrusions composing the second guide 40. As a result, the tag pin group T is pressed to the main body top surface, and is warped as shown in FIG. 7, so that it is not detached from the second guide 40 by itself.

Figure 10:
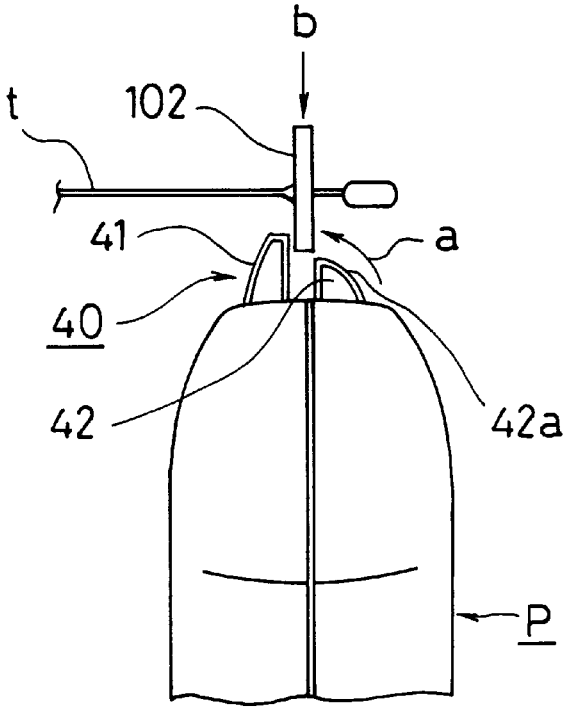
FIG. 10 is a process explanatory diagram of the process for supporting the tag pin group on the second guide.

Incidentally, as shown in FIG. 10, since the right protrusion 42 is formed on the smooth curved surface on its outer side 42*a*, after pushing the lower side of the lateral bar 102 against the inner wall of the left side large protrusion 41 by sliding along the outside 42*a* of the right protrusion 42 as indicated by arrow (a), when the lateral bar 102 is pushed down as indicated by arrow (b), the lateral bar 102 of the tag pin t may be easily set in the second guide 40.

Figure 11:
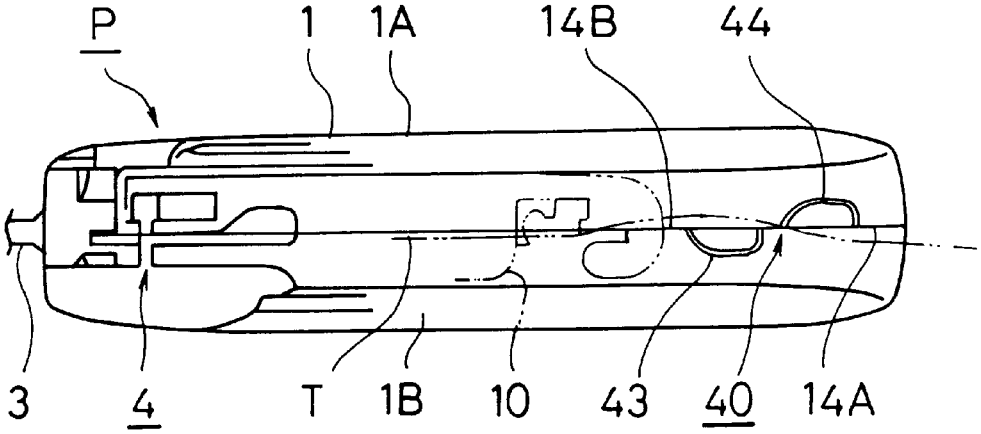
FIG. 11 is a plan view showing other embodiment of an apparatus for attaching tag pins of the invention.
Figure 12:
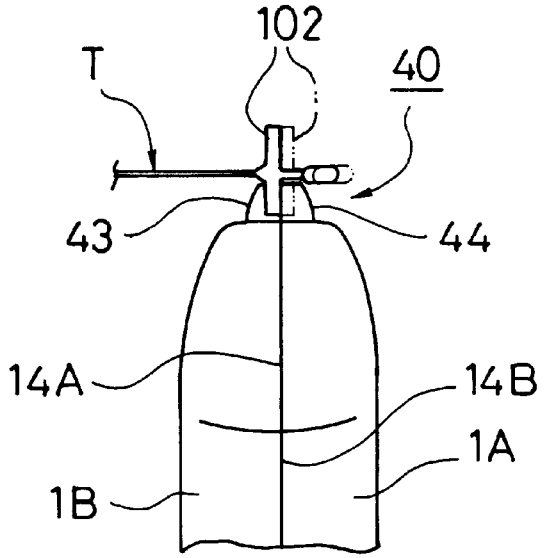
FIG. 12 is a rear view of the apparatus for attaching tag pins in FIG. 11.

One embodiment of the invention is described so far, but not limited to this, for example, the pair of right and left protrusions 43, 44 for composing the second guide 40 may be provided by shifting the phase in the lateral direction of the main body 1 as shown in FIG. 11 and FIG. 12, and the tag pin group T may be formed to meander in an S-curve.

In this case, the gap between the protrusions 43, 44 is enough for passing the lateral bar 102 of the tag pin. The forward protrusion 43 is provided flush with the junction 14B of the main body left side 1B, and the backward protrusion 44 is provided flush with the junction 14A of the main body right side 1A.

Figure 13:
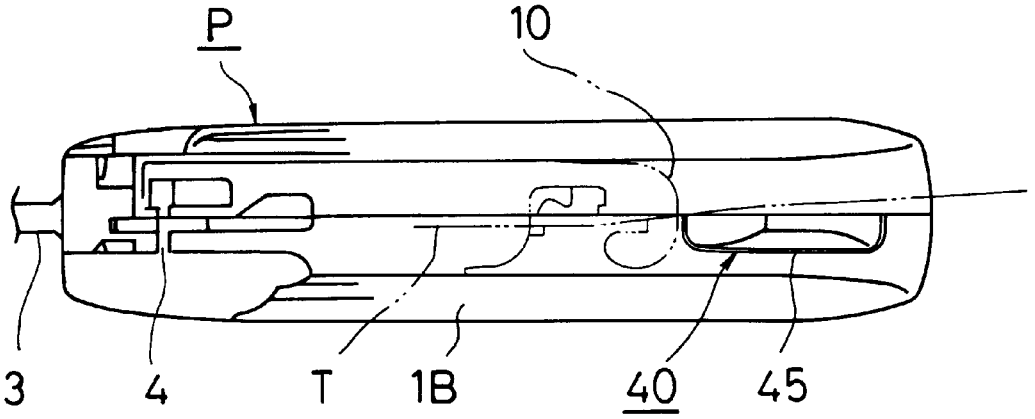
FIG. 13 is a plan view showing a different embodiment of an apparatus for attaching tag pins of the invention.
Figure 14:
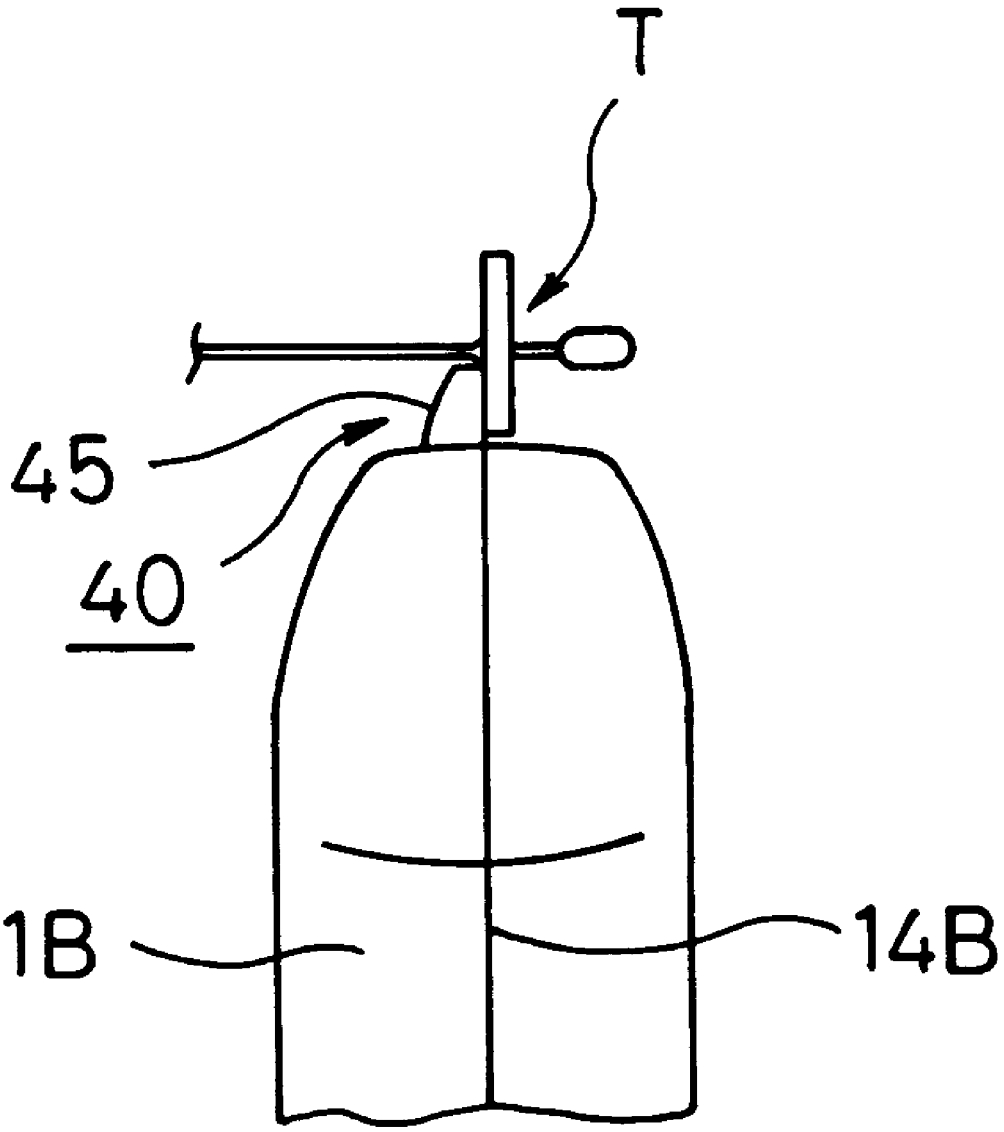
FIG. 14 is a rear view of the apparatus for attaching tag pins in FIG. 13.

As shown in FIG. 13 and FIG. 14, the second guide 40 may be formed only of the protrusion 45 disposed at the tag pin access 24 side of the first guide 10, thereby preventing the tag pin group T from swinging laterally to the left side of the main body 1.

In this case, the protrusion 45 is provided flush with the junction 14B of the main body left side 1B.

As shown in FIG. 7, meanwhile, an adhesive tape or an adhesive resin 50 may be adhered to the front of the main body 1 and at the root of the hollow needle 3. The adhesive tape 50 or the like may be replaced with a new one if the adhesion is lowered.

In such constitution, the label or price tag 51 attached by the tag pins t can be adhered to the root of the hollow needle 3, and it is not necessary to hold the label 51 or the like by using other hand on every occasion as required in the prior art, so that the label gluing job may be enhanced in efficiency.

Thus, according to the invention, the hook-shaped first tag pin group support guide is rotatably supported on the top of the main body of the apparatus for attaching tag pins, and the second tag pin group support guide for preventing lateral swing of the tag pin group is provided behind the first tag pin group support guide, and therefore, oscillation of the tag pin group between the main body of the apparatus for attaching tag pins and the first tag pin group support guide can be prevented by the first tag pin group support guide, and moreover lateral swing of the tag pin group can be prevented by the second tag pin group support guide, and moreover the tag pin group is prevented from being detached from the first tag pin group support guide.

In the invention, further, since the second tag pin group support guide is formed of a pair of right and left protrusions for supporting the lateral bar of the tag pins from both sides, lateral swing of the tag pin group after the first tag pin group support guide can be prevented.

Also, as in the invention, when the pair of right and left protrusions are provided by shifting the phase in the lateral direction of the main body, lateral swing of the tag pin group after the first tag pin group support guide can be prevented.

Moreover, as in the invention, when the second tag pin group support guide is composed only of the protrusion disposed at the tag pin group access side of the first tag pin group support guide, lateral swing of the tag pin group after the first tag pin group support guide can be prevented.

What is claimed is:

1. An apparatus for attaching tag pins to a commercial good by removing a piece of tag pin comprising a head portion and a lateral bar, both being connected to each other via a filament portion interposed therebetween, from a tag pin group in which a plurality of said tag pins are arranged parallel to each other, with each of said tag pins being connected to a longitudinal connecting rod through a respective coupling portion so as to form a comb like configuration, and by penetrating one of said tag pins through the good, wherein a first tag pin group supporting guide having a hook like shape is rotatably supported at a position on a top end surface of a main body of the apparatus and apart from a forwarding end portion thereof at which the tag pin is penetrated into the good, by a predetermined distance, and further wherein the apparatus being further provided with a second tag pin group supporting guide at a rear portion of said first tag pin group supporting guide with respect to said forward end portion so as to prevent lateral swing of said tag pin group.

2. An apparatus for attaching tag pins according to claim 1, wherein said second tag pin group supporting guide comprises a pair of protrusions, each of said protrusions being opposed to each other so as to support each one of said lateral bars of said tag pins at both sides thereof.

3. An apparatus for attaching tag pins according to claim 2, wherein said second tag pin group supporting guide comprises a pair of protrusions, each of said protrusions being arranged on a respective position, each being different from each other so as to be shifted in phase along the longitudinal direction of said main body.

4. An apparatus for attaching tag pins according to claim 1, wherein said second tag pin group supporting guide comprises only one protrusion located at a place facing an entrance or an exit portion of said tag pin group of said first tag pin group supporting guide.

* * * * *